United States Patent [19]

Pickering et al.

[11] Patent Number: 4,910,051

[45] Date of Patent: Mar. 20, 1990

[54] JEP BOW

[76] Inventors: Ernest W. Pickering; Jean R. Pickering, both of 436 Twin Bark Ave., Holbrook, N.Y. 11741

[21] Appl. No.: 235,546

[22] Filed: Aug. 24, 1988

[51] Int. Cl.[4] ..... D04D 7/10

[52] U.S. Cl. ..... 428/4; 223/46

[58] Field of Search ..... 428/4, 5, 121, 126; 28/147; 223/46

[56] References Cited

U.S. PATENT DOCUMENTS

| | | | |
|---|---|---|---|
| 2,105,436 | 1/1938 | Flatto | 428/5 X |
| 2,197,181 | 4/1940 | Katz | 428/7 X |
| 2,587,502 | 2/1952 | McMahon | 428/5 |
| 2,845,736 | 8/1958 | Crawford | 428/5 |
| 3,143,259 | 8/1964 | Paar | 428/5 X |
| 3,256,129 | 6/1966 | Wallerstein et al. | 428/5 |
| 3,283,339 | 11/1966 | Heifetz | 428/4 X |
| 4,339,059 | 7/1982 | Kenyon | 428/5 X |

*Primary Examiner*—Henry F. Epstein
*Attorney, Agent, or Firm*—Leonard Belkin

[57] ABSTRACT

A ribbon bow made from nested strips of material having natural curls along the edges thereof folded back and crimped using another strip to form the bow. The method is to nest one or more such strips and then fold them followed by crimping to form the bow.

9 Claims, 2 Drawing Sheets

FIG. 1
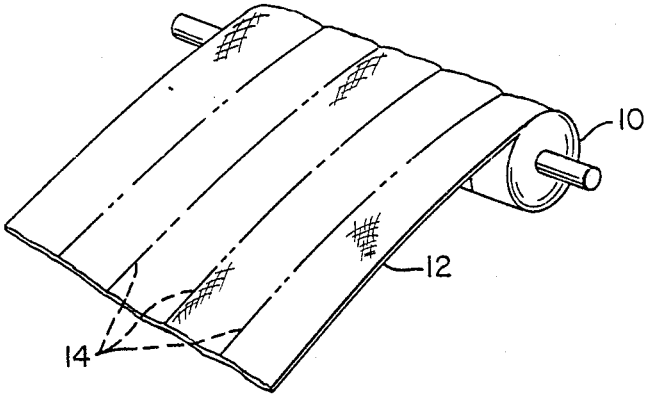
FIG. 2
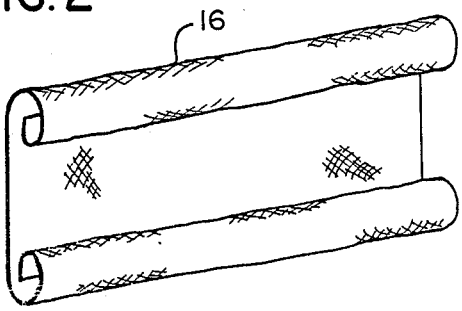
FIG. 3
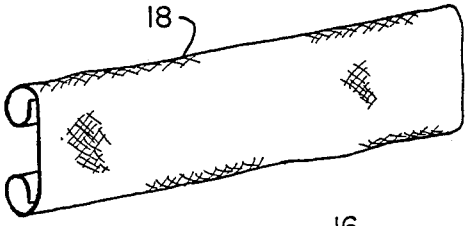
FIG. 4
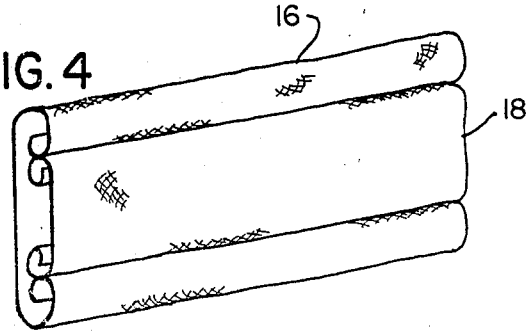
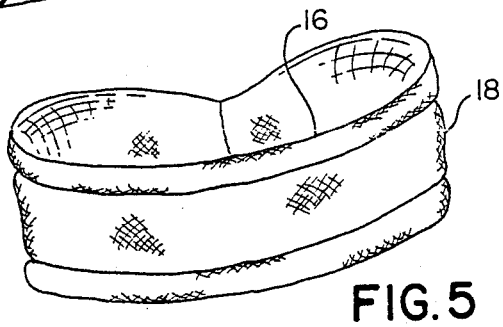
FIG. 5
FIG. 6
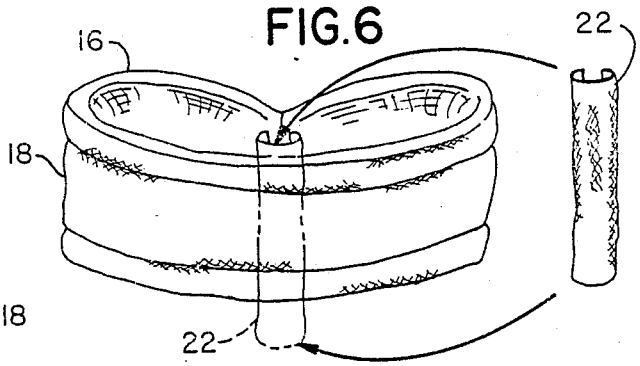
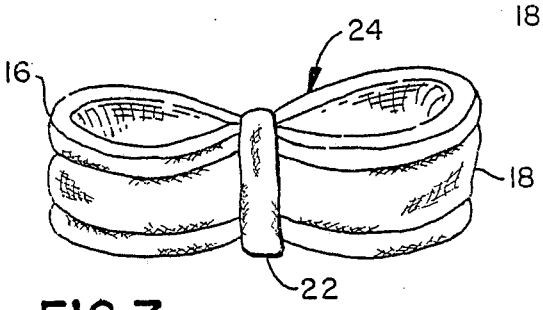
FIG. 7
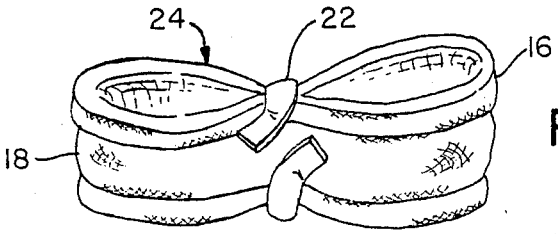
FIG. 8

JEP BOW

BACKGROUND OF THE INVENTION

This invention relates to ribbon bows and more particularly to a novel construction of decorative bows and methods of making same.

In the normal manufacture of bows, a strip of ribbon material is folded to produce a number of petals which are held in position by one or more bands. In such construction it is possible to obtain a limited variety in the display of the bands.

The variety and style of ribbon bows made according to conventional techniques as described above are limited and quite often require a series of complicated steps in their manufacture.

Typical bow constructions and methods of making same are shown in U.S. Pat. Nos. 2,105,436 (Flatto), 2,587,502 (McMahon), 2,845,736 (Crawford), 3,283,339 (Heifetz), and 4,339,059 (Kenyon). The preceding patents are representative of the state of the art and none discloses or suggests the present invention.

SUMMARY OF THE PRESENT INVENTION

In the present invention, ribbon bows are made from strips of suitable material such as woven metallic acetate polyester fibers having inherent stresses which cause the strips to curl orthogonally to the lengths of the strips.

In accordance with a preferred embodiment of the invention, a strip of such material is cut into suitable lengths and superimposed on each other in one or more of a variety of ways to obtain a desired effect, and then the nested ribbon strips are folded to obtain a ribbon bow configuration.

The method of preparing the ribbon bows in accordance with this invention is simple, efficient, and economical and produces bows which are suitable for a variety of applications as will be apparent from the description below of preferred embodiments of the invention.

It is thus a principal object of this invention to provide an improved method of producing ribbon bows which is novel in construction and appearance.

Other objects and advantages of this invention will hereinafter become obvious from the following detailed description of preferred embodiments of this invention.

BRIEF DESCRIPTION OF THE FIGURES

FIG. 1 is a perspective view of a roll of material to be used to carry out the principles of this invention.

FIG. 2 is a perspective view of a strip of ribbon material taken from the roll shown in FIG. 1 to be employed in making a bow in accordance with the principles of this invention.

FIG. 3 is a similar view of the opposite side of a strip to be nested in with the strip shown in FIG. 2.

FIG. 4 is a perspective view of the strips of FIGS. 2 and 3 nested together with the convex side of the inner strip facing outwardly.

FIG. 5 is a perspective view of the strips of FIG. 4 being folded.

FIG. 6 is a view similar to that of FIG. 5 with a tie to be employed to form the bow.

FIG. 7 is a front perspective view of the bow being formed with the tie in place.

FIG. 8 is a back perspective view of the bow of FIG. 7 with the tie being tucked ready to be attached.

DETAILED DESCRIPTION OF THE PREFERRED EMBODIMENTS

Figure 9:
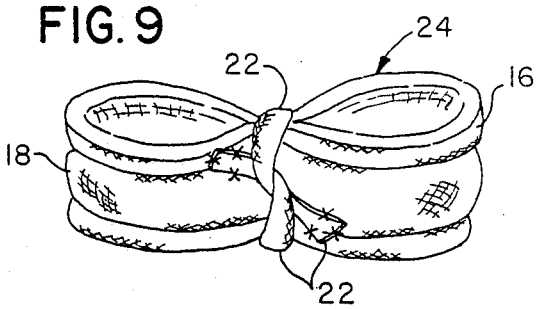
FIG. 9 is a view of the bow of FIG. 8 with the tie being tacked into place.

The material required for use in making this invention is one in which the material incorporates inherent stresses so that each strip employed in forming the bow tends to form a curl which is parallel to the length of the strip, that is, a curl which is perpendicular to the orthogonal axis of the strip.

Any material having the characteristics described above would be suitable for the present invention. However, the material actually employed for making these bows is commercially available woven acetate polyester fibers containing metallic threads coming off rolls and prior to being heat treated to remove the stresses which come about as a result of the manufacturing process. Normally, such material is heat treated in order to relieve the internal stresses present as the result of the weaving process so that the sheets will remain flat. But, in the present invention, the material is employed prior to the heat treatment so that the stresses remain in order to permit this invention to be practiced as will hereinafter described. One of the advantages of the metal threads employed in the material is that it glitters and enhances the utility of the bow.

Referring to FIG. 1, coming off roll 10 is a sheet of woven metallic acetate polyester material 12 which has just been manufactured but not yet treated to relieve stresses which have been built up during the weaving process, as is understood in the art. This material is commercially available. The strips of material to be used in the making of the bows are cut from the material along the broken lines designated by the numeral 14. While the width and length of the strips cut would depend on the size of the bows to be made as well as which embodiment is to be produced, typically the strips would be 1½ to 3 inches wide and in the range of about six to 12 inches in length.

As seen in FIG. 2, foundation strip 16 displays its natural or inherent curl along each of the long edges with both curls along opposite edges facing in the same direction. In FIG. 3, a second or nesting strip 18 is shown facing in the opposite direction, that is, the back or convex side of strip 16 being seen. By front of strip herein is meant the concave side of the strip in which the curls are exposed and visible.

To prepare a bow in accordance with a preferred embodiment of this invention, strip 18 is placed inside of strip 16 with the curls of strip 18 facing strip 16, as seen in FIG. 4. Due to the flexible nature of the material involved, the curls are either spread apart (as in the case of strip 16) or pushed together (as in the case of strip 18) or a combination of both to form the assembly shown. As will be seen below in connection with another embodiment of this invention, nesting strip 18 can be reversed, that is, with its front or concave side facing outwardly, that is, in the same direction as strip 16.

Figure 10:
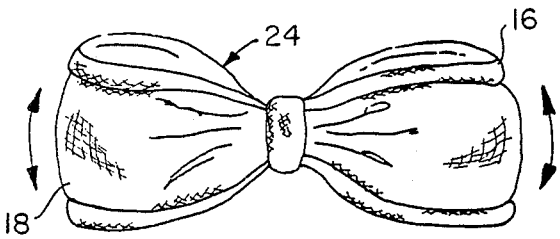
FIG. 10 is a perspective view of the bow formed in FIGS. 1–8 in the process of being fanned out.
Figure 11:
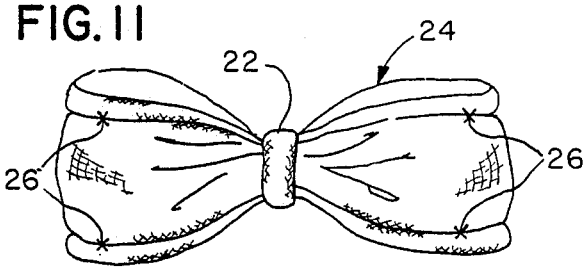
FIG. 11 is a perspective view of the completed bow with the locations shown where tacking stitches are applied to maintain the fanning out.
Figure 12:
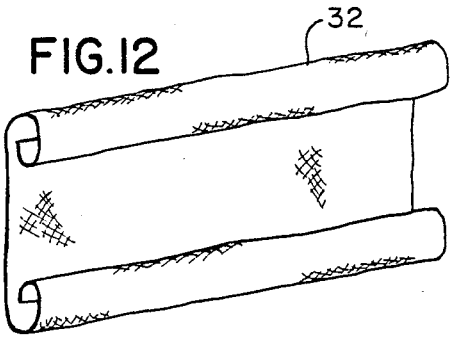
FIGS. 12–14 show three strips ready for assembling another embodiment of this invention.

As seen in FIG. 5, the assembly shown in FIG. 4 is then folded over toward the flat or rear surface of strip 16, while as seen in FIGS. 6 and 7 a third strip 22 similar to strips 16 and 18 is folded over to crimp the center and tacked together in the back as illustrated in FIGS. 8 and 9, forming the basic configuration of bow 24. In order to complete bow 24, the wing or ends of bow 24 are grasped and spread apart as shown by the double headed arrows in FIG. 10 and tacked at locations 26 to maintain the fanning which is accomplished by the spreading action just described.

In another embodiment of this invention, shown in FIGS. 12 to 15, three strips of material can be employed, using a foundation strip 32 and a pair of nesting strips 34 and 36. In this embodiment, nesting strips 34 and 36 are reversed so that their backs are facing the back of strip 32 so that all the curls will be exposed on the visible side of the bow producing a unique effect. Of course, if desired, nesting strip 36 could be facing toward the back of strip 32.

Figure 15:
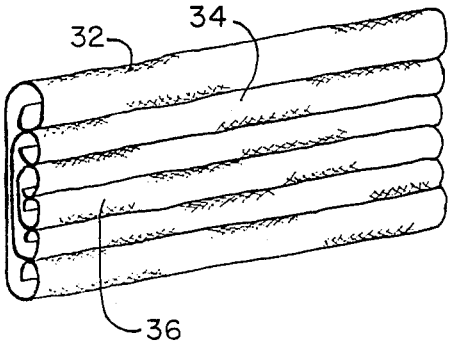
FIG. 15 shows the three strips of FIGS. 12–14 nested with the interior strips having their concave portions extending outwardly.

To complete construction of the bow from the strips shown in FIG. 15, the assembly would be folded back as in the case shown for the embodiment of FIGS. 2–11, and and subsequent steps followed in the manner previously described.

Figure 16:
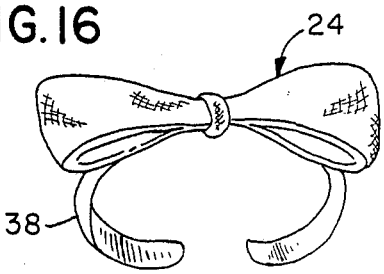
FIG. 16 is a perspective view of a head band on which a bow made in accordance with this invention is mounted.
Figure 13:
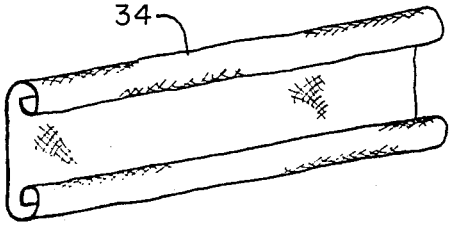
Figure 14:
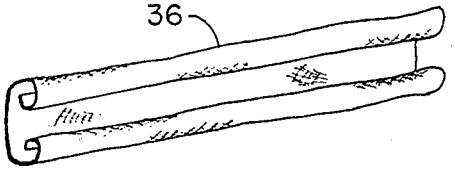
Figure 17:
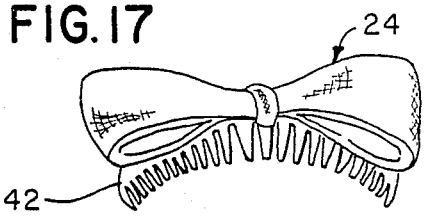
FIG. 17 shows such a bow mounted on a comb.
Figure 18:
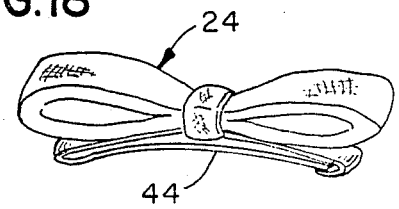
FIG. 18 shows such a bow mounted on a barrette.

The ribbon bows hereinabove described may be used in a variety of ways. As seen in FIG. 16, bow 24 or any of its other embodiments may be mounted on a headband 38, or as seen in FIG. 17, bow 24 may be mounted on a comb 42, or, as seen in FIG. 18, mounted on a barrette 44.

It is thus seen that there has been provided a unique bow construction and a method for making such a bow. While only certain preferred embodiments of the invention have been described, it is understood that many variations are possible without departing from the principles of this invention as defined in the claims which follow.

What is claimed is:

1. A ribbon bow comprising a first strip of material of woven acetate polyester fibers having inherent curls along both edges facing in the same direction and a second strip of material having inherent curls along both edges facing in the same direction said second strip being nested in said first strip between the curls of the latter with the curls of said second strip abutting against the curls of said first strip, the nested strips being folded back at the free ends with the nested strip facing outwardly, the folded ends of said strips coming together, means tying back the folded ends of said strips, said means comprising a third strip of material having similar inherent curls along the long edges thereof.

2. The ribbon bow of claim 1 wherein the concave side of said second strip is facing said first strip.

3. The ribbon bow of claim 1 wherein the convex side of said second strip is facing said first strip.

4. The ribbon bow of claim 1 wherein the said strips are fanned out adjacent the folds.

5. The ribbon bow of claim 1 wherein said material contains metallic threads to produce a glitter.

6. The ribbon bow of claim 3 wherein a third strip of material having inherent curls along the edges thereof facing in the same direction is nested in said second strip, all of said strips having their concave surfaces facing outwardly.

7. The method of making a bow comprising the steps of:

a. selecting a strip of material having inherent curls along the long edges thereof facing the same direction forming the front of said strip;

b. nesting a second strip of material having curls along the long edges thereof facing the same direction forming the front of said second strip into said first strip so that said second strip fills the space between the curls in said first strip and the adjacent curls of said strips abutting each other;

c. folding back the ends of said first and second strips with said ends coming together so that said second strip is exposed outwardly;

d. looping a third strip around the center of the folded strips so as to form a crimped section in the center and wings extending outwardly showing said first strip with said second strip nesting therein; and e. fanning said wings.

8. The method of claim 7 in which the concave side of said second strip faces said first strip.

9. The method of claim 7 in which the convex side of said second strip faces said first strip and a third strip of material having inherent curls along the long edges is nested in said second strip so that the concave surfaces of all said strips face outwardly.

* * * * *